US006857629B2

(12) United States Patent
Fritz et al.

(10) Patent No.: US 6,857,629 B2
(45) Date of Patent: Feb. 22, 2005

(54) AUTOMATED RECIPROCAL STACKING ASSEMBLY

(76) Inventors: Charles W. Fritz, 529 Timber Creek Dr., Akron, OH (US) 44333; Rein Mulder, 708 Dominic Dr., Cuyahoga Falls, OH (US) 44223

( * ) Notice: Subject to any disclaimer, the term of this patent is extended or adjusted under 35 U.S.C. 154(b) by 83 days.

(21) Appl. No.: 10/359,225

(22) Filed: Feb. 6, 2003

(65) Prior Publication Data

US 2004/0156707 A1 Aug. 12, 2004

(51) Int. Cl.[7] ..... B65H 45/20

(52) U.S. Cl. ..... 270/30.01; 414/792.2; 493/415

(58) Field of Search ..... 19/160, 163; 270/30.01, 270/30.09, 39.01, 39.05; 414/791.2, 792.2, 788.6, 789.8, 792; 493/413, 414, 415

(56) References Cited

U.S. PATENT DOCUMENTS 3,913,904 A 10/1975 Occhetti
4,074,901 A * 2/1978 Catallo ..... 493/413
4,507,109 A 3/1985 Meschi ..... 493/356
5,064,179 A 11/1991 Martin ..... 270/39
5,423,733 A * 6/1995 Adachi ..... 493/414
6,155,551 A 12/2000 Russ et al. ..... 270/30.01

* cited by examiner

*Primary Examiner*—Janice L. Krizek
(74) *Attorney, Agent, or Firm*—Richard C. Litman

(57) ABSTRACT

An automated reciprocal stacking assembly for stacking thin, narrow, continuous sheets of stock material. The automated reciprocal stacking assembly has a stationary outer frame, a laterally reciprocating inner frame, a vertically moveable carriage, a reciprocating distribution head, a base member, a pair of sheet retaining arms, a rotating platform for supporting a pallet and a conveyor belt. The reciprocating distribution head comprises a pair of feeding belts that are driven by a positive timing belt. The continuous sheet of stock material is supplied to the reciprocating distribution head by the conveyor through a large opening between the feeding belts of the reciprocating distribution head. The oppositely moving feeder belts force the stock material out of the reciprocating distribution head and onto a pallet.

12 Claims, 4 Drawing Sheets

AUTOMATED RECIPROCAL STACKING ASSEMBLY

BACKGROUND OF THE INVENTION

1. Field of the Invention

The present invention relates to automated material handling devices, and more particularly to an automated, multi-belt distribution head reciprocating stacker for sheet, strip material.

2. Description of the Related Art

Rubber is often manufactured in the form of a thin and narrow sheet of material. The thin, narrow rubber sheets are commonly produced in a continuous manner resulting in an extremely long sheet of rubber. It is not possible to store, package or transport the rubber in long flat sheets, so the rubber is commonly folded into a multilayer pile and stacked on a pallet for storage and shipping. The rubber sheet may be folded and stacked onto the pallets by hand, but this is an inefficient process. Many devices are used to automate the process of folding the rubber sheets. These stacking and folding devices commonly comprise an assembly of conveyor belts and distribution heads to evenly stack the rubber sheets onto manageable piles. A network of computers that are programmed for the specific process controls the assembly.

Specific examples of automated sheet material stackers that are illustrative of the present industry are discussed in the following patent documents.

U.S. Pat. No. 3,913,904 to Occhetti discloses a stacking machine for rubber sheet material. The patent discloses an assembly for automatically converting a continuous delivery of sheet material into a horizontally reciprocating motion for creating a uniform stack of sheet material. The reciprocating mechanism includes a cut-off device so that discrete sheets are created to a precise length and so that all cut sheets are stacked vertically. The Occhetti device provides for the stacking of relatively wide sheet material that is about equal in width to the size of the pallet.

U.S. Pat. No. 6,155,551 to Russ et al. discloses a reciprocating stacker for stacking a relatively thin, flexible and continuous sheet of material evenly onto a pallet The stacker includes a distribution head, which receives the sheet material from a conveyor belt and distributes it onto a pallet. The head reciprocates in a first direction to lay the material out in a zigzag while simultaneously translating in a second direction normal to the first direction to distribute the material evenly laterally across the surface. The feeder head comprises a set of rollers driven by means of a rack and pinion gear arrangement. This feeder head requires the movement of the carriage in order to provide a driving force for the rollers and thus dispense the sheet material.

U.S. Pat. No. 4,507,109 to Meschi discloses an apparatus for reception and transfer of sheet material. The apparatus is adapted to receive printer sheets and form the long printer sheets into evenly distributed stacks. The apparatus includes a guiding means, a control operated cutting means, and a supporting and piling means.

U.S. Pat. No. 5,064,179 to Martin discloses a method of forming zigzag shaped piles from a continuous band of a flexible material and a machine for carrying out the method. The band of material is deposited and folded onto a support, and at the end of the formation of a pile the band is ruptured along a predetermined folding line, the forward movement of the band is stopped and the pile is removed. This method is discussed for use in high speed printers.

There are many different types of rubber that are formed in long sheets that must be handled by the stacking assemblies discussed above. Many problems exist with the existing stacking assemblies due to the fact that there are varying types of rubber produced. Different types of rubber stock react differently due to the plasticity and tensile characteristics of the rubber. When referring to plasticity, the reference is to the degree to which a material is capable of being permanently deformed. When referring to tensile, the reference is to a measure of the strength of a material, and more particularly to the maximum tolerable load per unit of original area. Many of the existing stacking assemblies require mechanical adjustments when different types of rubber are used.

Another problem is that when rubber is produced the thickness of the stock sheet is not always uniform. The existing stacking assemblies commonly have a low tolerance for variable stock thickness. If the distance between the assembly's rollers is not wide enough for the stock to pass through, the distance must be adjusted by loosening the fasteners holding the rollers in place. Another problem is that, due to variable stock thickness, it is sometimes necessary to vary the speed of the stock that is distributed onto the stack. It is advantageous to be able to distribute more or less material to enable the stacker to maintain a uniform stack.

Therefore, there is a need for an automated reciprocal stacking assembly that is capable of handling and distributing a continuous sheet of material into a stack of a predetermined height onto a pallet for storing and shipping. It is also desirable to have an automated reciprocal stacking assembly that provides an increased opening to allow for a much wider entrance for the rubber stock for automated loading of the stock material. Another need is for an automated reciprocal stacking assembly that provides a set of distribution belts that are held together by a tensioning device that allows the assembly to accommodate a large variation in stock sheet thickness. It is further desirable to have an automated reciprocal stacking assembly that is capable of varying the stock distribution speed across the linear plane of motion, allowing the amount of stock material to be varied to maintain a uniform stack of rubber. A further benefit would be provided by an automated reciprocal stacking assembly that provides a computer control program that may be altered to consider the plasticity, rebound and tensile properties of varying rubber stocks.

None of the above inventions and patents, taken either singly or in combination, is seen to describe the instant invention as claimed. Thus an automated reciprocal stacking assembly solving the aforementioned problems is desired.

SUMMARY OF THE INVENTION

The present invention is an automated reciprocal stacking assembly for a relatively thin and flexible continuous sheet of stock material. The automated reciprocal stacking assembly is particularly adapted for stacking continuous strips of rubber on pallets during the manufacture of tires, but is not limited to being used in this manner, and may be used for any appropriate application. The present automated reciprocal stacking assembly is useful for stacking any other materials with similar characteristics and dimensions as the sheet rubber.

The automated reciprocal stacking assembly has an outer frame, an inner frame, a carriage, a distribution head, base members, sheet retaining means, a rotating platform and a conveyor means. The outer frame is vertically disposed and stationary. The base members extend outward from the outer frame and are located beneath the carriage and rotating platform. The inner frame is vertically disposed and attached to the outer frame. The inner frame is not stationary and reciprocates laterally. The carriage extends horizontally from the inner frame and moves vertically up and down the front of the inner frame.

The conveyor means is located above the distribution head and is attached to the top of the outer frame. The conveyor means is a typical roller conveyor. The conveyor means includes an output end that is disposed above the distribution head. The conveyor means delivers a continuous length of stock material to the distribution head for stacking on the rotating platform.

The distribution head comprise a plurality of feeder belts, a positive timing belt, a tensioning device and a large opening between the feeder belts. The large opening between the feeder belts allows for a much wider entrance for the stock material delivered from the conveyor belt. The tensioning device holds together the feeder belts. The tensioning device is in the form of a spring or an air cylinder. The tensioning device provides an easy means for adjusting the distance between the feeding belts for increasing the tolerance of variable stock thickness.

The rotating platform is located underneath the carriage on top of the base members. A pallet is located on the top surface of the rotating platform for receiving the distributed stock material. The rotating platform allows for the layers of stock material to be placed on the pallet in different directions. Once a first layer of stock material is placed onto the pallet the rotating platform rotates 90 degrees so that the next layer of material is placed on the pallet in a direction normal to that of the first layer.

The two sheet retaining means are located on opposite ends of the underside of the carriage. Each of the sheet retaining means comprises a pneumatically actuated, moving arm and a grip means. When the distributed stock material reaches the end of the pallet the sheet retaining means fold the material down before the reciprocating distribution head moves back in the other direction.

The automated reciprocating stacking assembly also comprises a set of drive means. The first drive means laterally reciprocates the inner frame on the outer frame. This allows the outer frame to move the carriage and distribution head laterally to distribute each strip of material on a given layer of stock material on the pallet. The second drive means moves the carriage vertically on the inner frame. As the layers of stock material increase in height the carriage must be moved upward vertically to allow for new layers of material to be added to the stock pile. The third driving means reciprocates the distribution head along the carriage. This allows the distribution head to move forward and back to distribute strips of stock material along the pallet.

The first and second drives include threaded lateral and vertical shafts with cooperating threaded engagements for the inner frame and the carriage respectively. The third driving means includes a linear module timing belt drive. Each of the three drives is powered by an electric motor.

The feeding belts are driven by two separate mechanisms. The feeding belts can be driven by the movement of the carriage. When the carriage moves from the rear position to the front, the stock material is driven through the feeding belts in a one-to-one ratio in a downward direction. Conversely, when the carriage is moved from front to back, the stock material is driven in a one-to-one ratio in an upward direction.

The feeding belts can also be driven by the timing belt. By driving the timing belt by an independent motor, the feeding belts can be controlled independently of the linear motion. The timing belt can drive the distribution head at any speed or in either direction. This allows for the distribution speed to be varied as the stock material is delivered to the pallet. This allows for more or less stock material to be distributed at a given location to provide a more uniform stock pile of material.

Accordingly, it is a principal object of the invention to provide an automated reciprocal stacking assembly that is capable of handling and distributing a continuous sheet of material into a stack of a predetermined height onto a pallet for storing and shipping.

It is another object of the invention to provide an automated reciprocal stacking assembly with an increased opening to allow for a much wider entrance for the rubber stock for automated loading of the stock material.

It is a further object of the invention to provide an automated reciprocal stacking assembly with a set of distribution belts that are held together by a tensioning device that allows the assembly to accommodate a large variation in stock sheet thickness.

Still another object of the invention is to provide an automated reciprocal stacking assembly that is capable of varying the stock distribution speed across the linear plane of motion, allowing the amount of stock material to be varied to maintain a uniform stack of rubber.

Still another object of the invention is to provide an automated reciprocal stacking assembly with a computer control program that may be altered to consider the plasticity, rebound and tensile properties of varying rubber stocks.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an automated reciprocal stacking assembly for a relatively thin and flexible continuous sheet of stock material. The automated reciprocal stacking assembly is particularly adapted for stacking continuous strips of rubber on pallets during the manufacture of tires, but is not limited to being used in this manner and may be used for any appropriate application. The present automated reciprocal stacking assembly will be useful for stacking any other materials with similar characteristics and dimensions as the sheet rubber.

Figure 1:
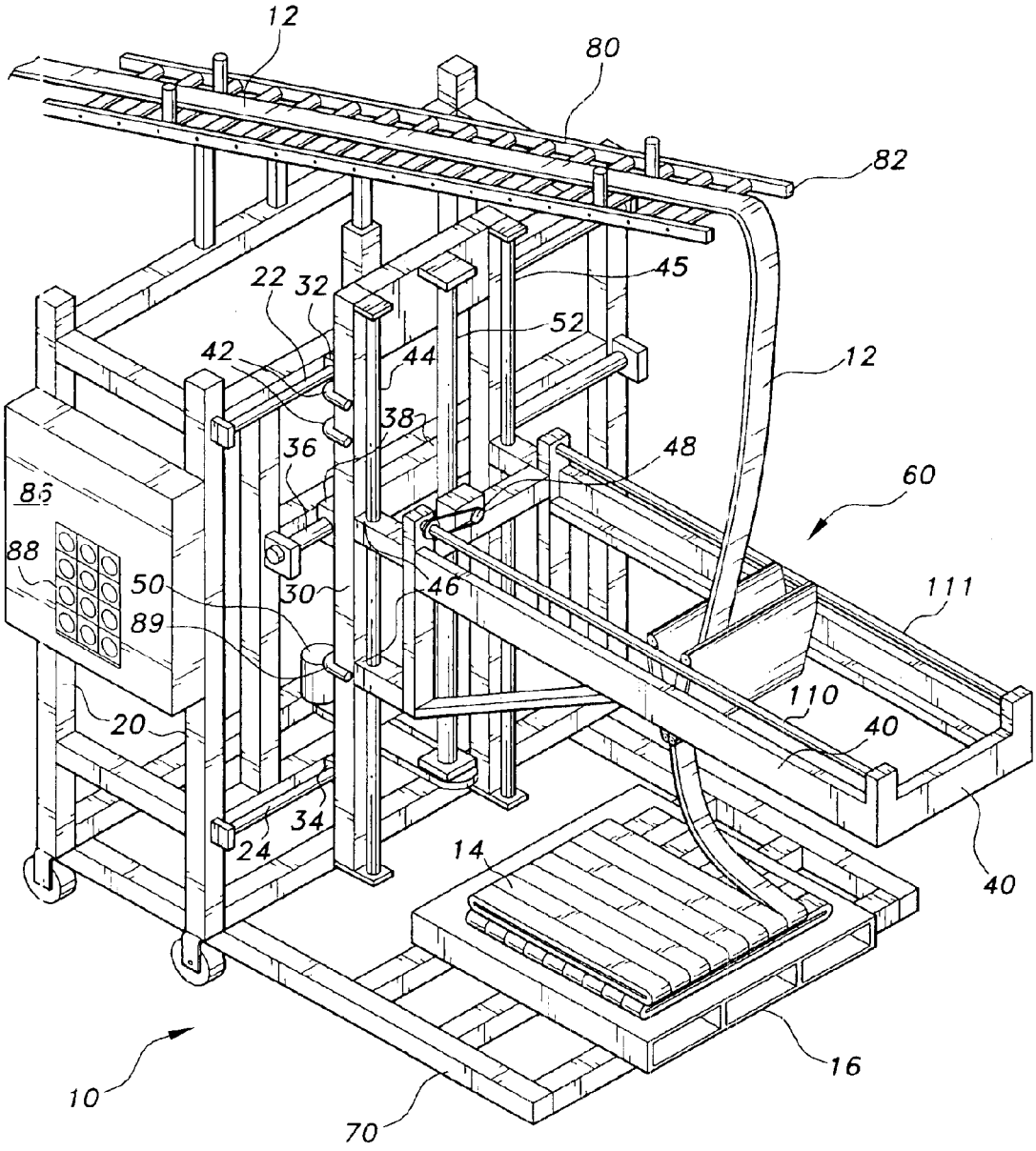
FIG. 1 is an environmental, perspective view of an automated reciprocal stacking assembly according to the present invention.

FIG. 1 depicts an environmental, perspective view of an automated reciprocal stacking assembly 10 according to the present invention. The moving components of the automated reciprocal stacking machine 10 extend from a stationary, vertical outer frame 20. The outer frame 20 is made from any suitable, sturdy structural material including, but not limited to, steel, rectangular tubing, angle or channel beams. The outer frame 20 provides support for the remaining structure and elements of the automated reciprocal stacking assembly 10.

The outer frame 20 includes upper and lower lateral supports 22 and 24, respectively. The lateral supports 22 and 24 support the vertical, laterally reciprocating inner frame 30 by upper and lower bearing members 32 and 34, respectively. The bearing members 32 and 34 extend from the inner frame 30. An inner frame drive 36 extends across the outer frame 20 to engage the inner frame 30 and drive the inner frame 30 laterally back and forth with respect to the outer frame 20. The inner frame drive 36 may comprise a screw jack that engages threaded drive attachments 38 on the inner frame 30. The inner frame drive 36 is powered by an electric motor 39 (depicted in FIG. 2). The inner frame drive 36 may alternatively comprise rack and pinion gears, pneumatic or hydraulic rams or struts, or any other suitable type of drive means.

The carriage 40 extends outwardly from the laterally reciprocating inner frame 30. The carriage 40 generally comprises a pair of spaced apart structural members similar to those used in the construction of the outer frame 20. The carriage 40 reciprocates vertically up and down the front of the inner frame 30 by means of a drive mechanism similar to that for the inner frame 30. Proximity limiting mechanisms 42, in the form of switches, are used to limit the motion of the inner frame 30 relative to the outer frame 20, and the carriage 40 to the inner frame 30.

A support and drive means is provided to drive the carriage 40 vertically up and down the front of the inner frame 30. The carriage 40 support and drive means comprises a pair of drive slides 44 and 45, disposed vertically in the inner frame 30. The carriage 40 includes bearing members 46 that engage the drive slides 44 and 45 and secure the carriage 40 to the inner frame 30. The bearing members 46 also allow for the carriage 40 to slide vertically relative to the inner frame 30. The carriage drive 52 may comprise a screw jack, as described above. The carriage drive 52 is disposed vertically between the drive slides 44 and 45, with a threaded attachment engaging the carriage drive 52. The threaded attachment is not shown in the figures but is essentially the same as the drive attachment 38 shown in FIGS. 1 and 2 for driving the inner frame 30. The carriage drive 52 may alternatively comprise rack and pinion gears, pneumatic or hydraulic rams or struts, or any other suitable type of drive means. The carriage drive 52 is powered by a carriage drive motor 50. The carriage drive 52 causes the carriage 40 to move upward or downward along the inner frame 30, depending on the motion of the carriage drive 52 screw jack.

The horizontally disposed carriage 40 includes a slide system allowing the distribution head 60 to move back and forth. A combination of a drive system and position feedback allows for accurate positioning of the distribution head 60. The drive 48 may be a timing belt, rack and pinion gears, pneumatic rams or struts, or any other suitable type of drive means.

Figure 2:
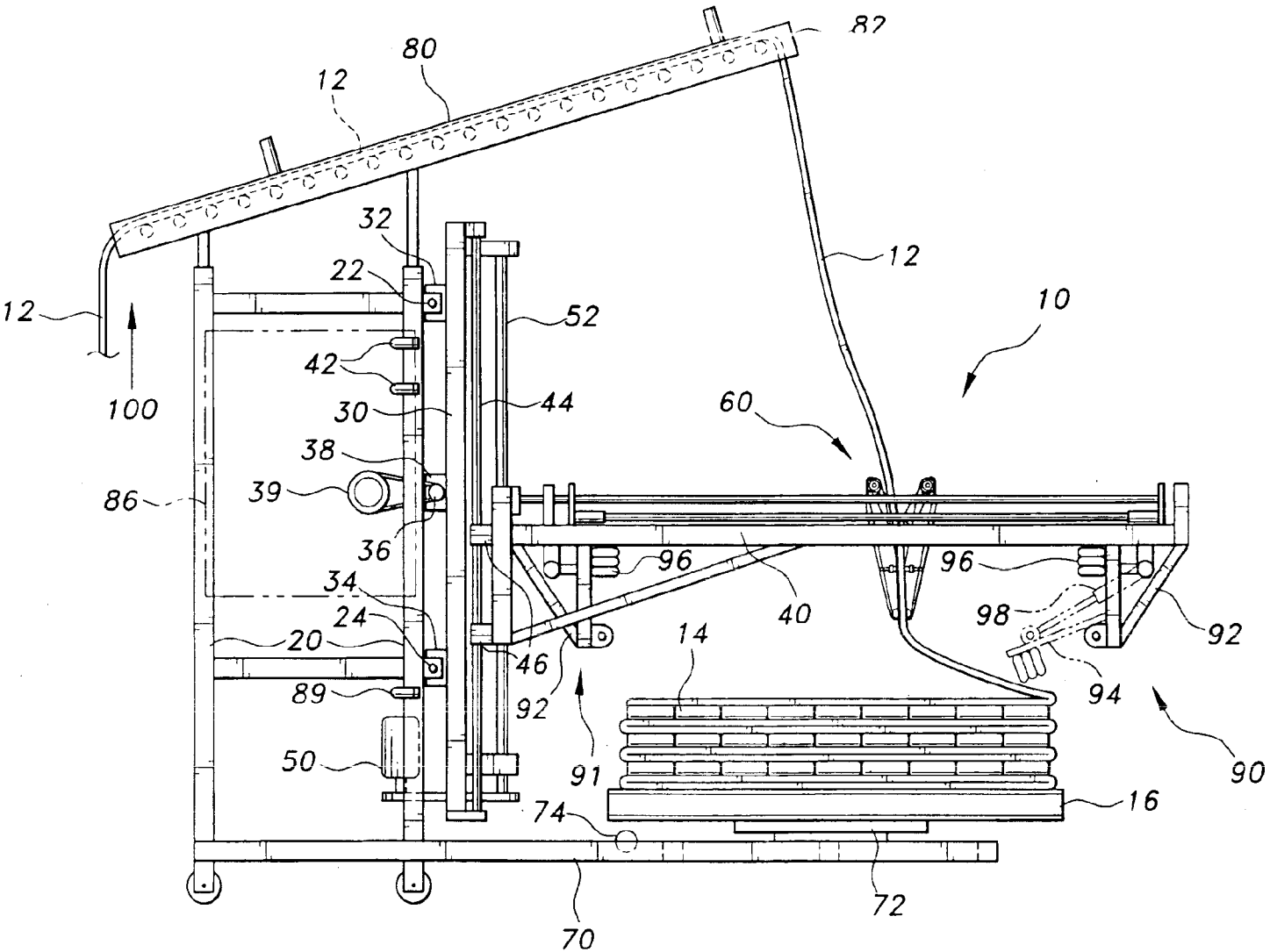
FIG. 2 is a side view of the automated reciprocal stacking assembly depicted in FIG. 1.
Figure 3:
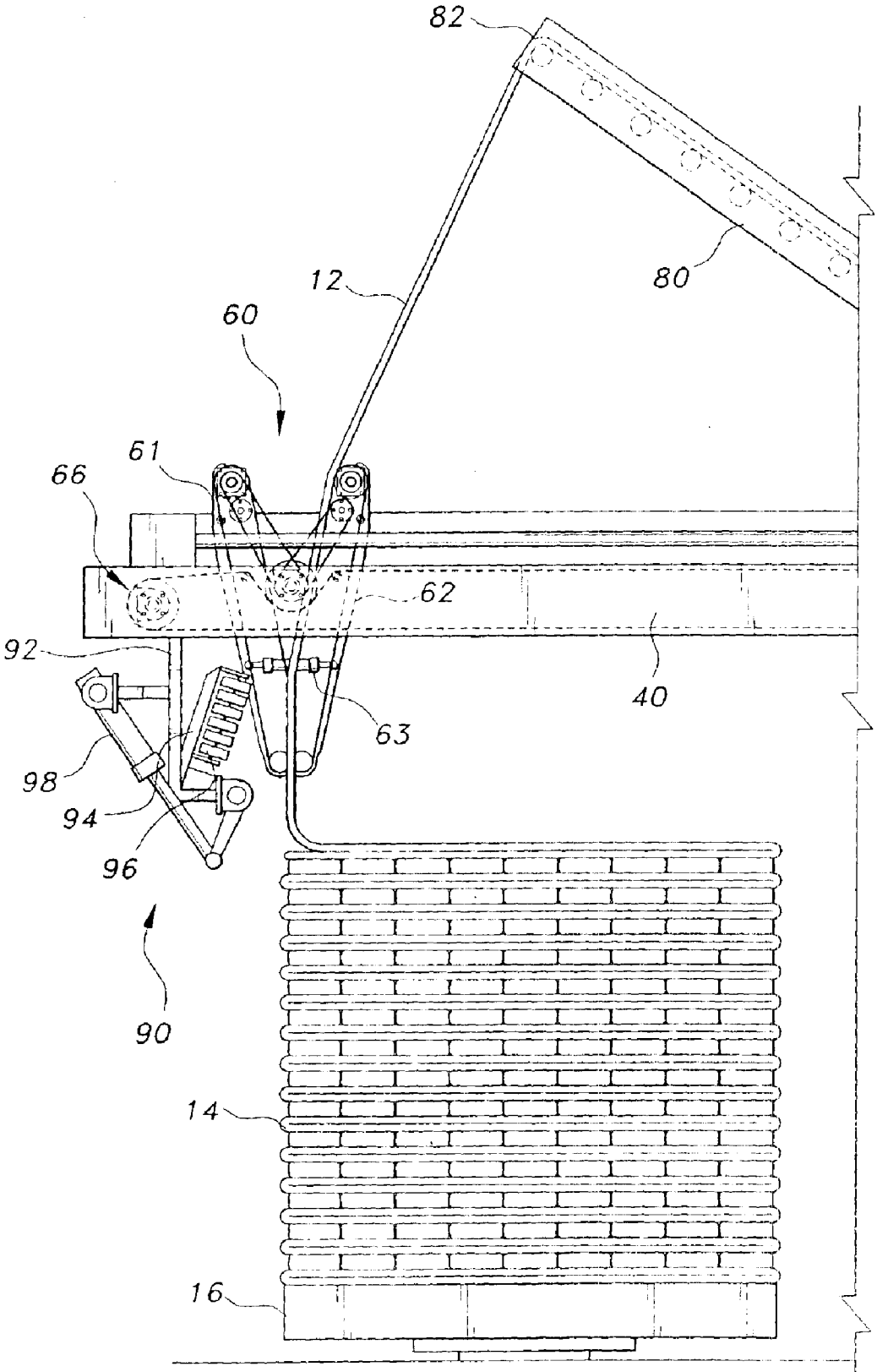
FIG. 3 is a fragmented side view of the automated reciprocal stacking assembly showing further details of the assembly.
Figure 4:
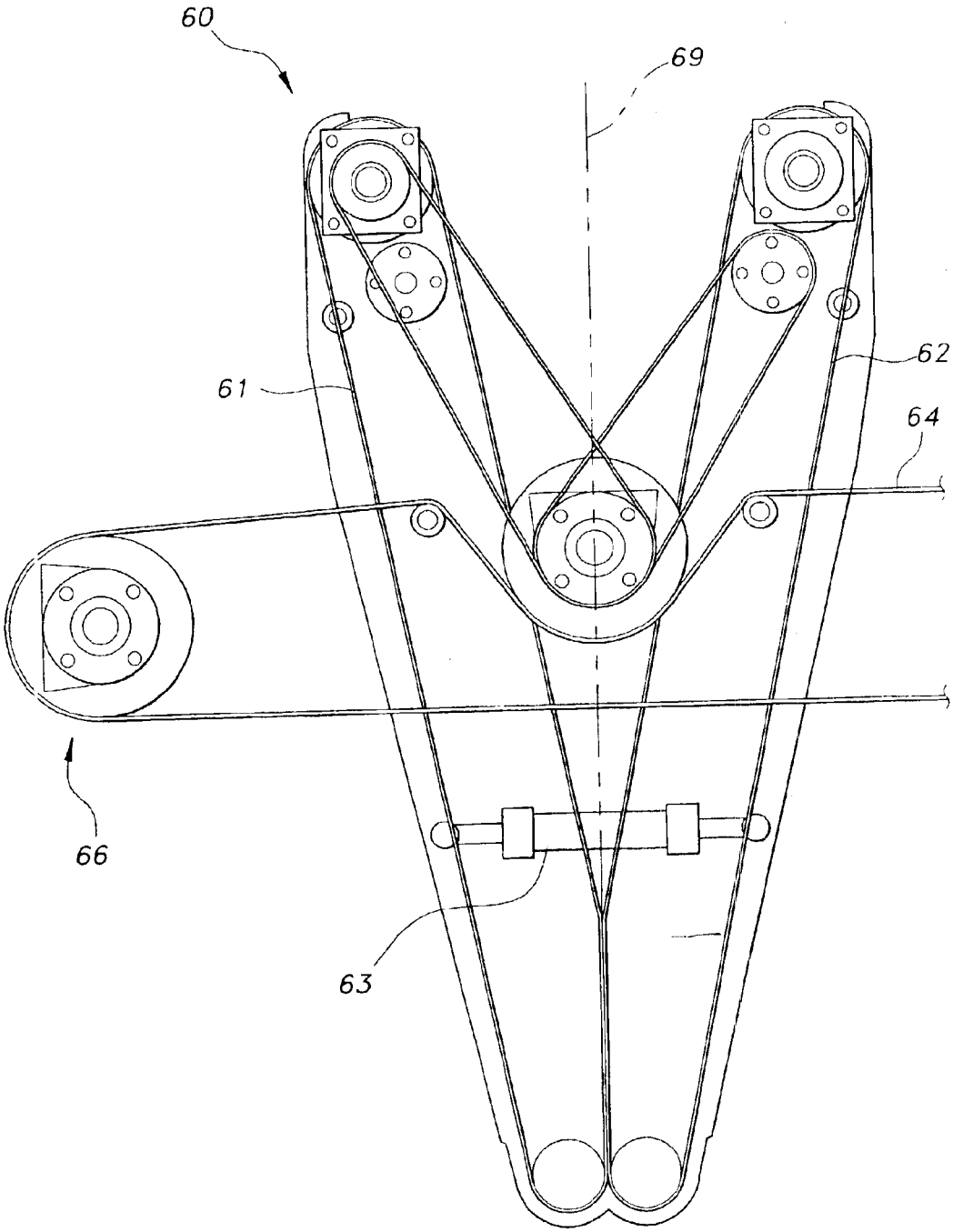
FIG. 4 is a side view of a distribution head used in the automated reciprocal stacking assembly.

FIG. 2 depicts a side view of the automated reciprocal stacking assembly 10. FIG. 3 shows an enlarged side view of a portion of FIG. 2. FIG. 3 clearly depicts the reciprocating distribution head 60 attached to the carriage 40. FIG. 4 shows an enlarged view of the distribution head 60 isolated from the automated reciprocal stacking assembly 10. The reciprocating distribution head 60 includes a plurality of feeder belts 61 and 62, a tension device 63, a positive timing belt 64, and a timing belt drive 66. In the embodiment shown, the reciprocating distribution head 60 uses two feeder belts 61 and 62. The two feeder belts 61 and 62 move in opposite directions and force the stock material 12 out of the distribution head 60 and onto the pallet 16 to form a stock pile 14.

The feeder belts 61 and 62 are held together by a tension device 63. The tension device 63 is in the form of a spring or an air cylinder, but is not limited in this manner and may be any suitable tensioning device. The tensioning device 63 allows for the space between the feeder belts 61 and 62 to be changed without having to manually adjust and reattach bolts or other like fasteners. This allows for an increased tolerance of variable stock material thickness. Also, a large open space 69 is located between the top portion of the feeder belts 61 and 62. This large opening allows for easier automatic loading of the stock material 12 into the distribution head 60. The positive timing belt 64 is located on, and runs along, the underside of the carriage 40.

The driving force of the feederbelts 61 and 62 is dependant on two forces. With the timing belt 64 stationary, the feeder belts 61 and 62 are driven based on the movement of the carriage 40. The result is that when the carriage 40 moves from the rear position toward the front, the stock material 12 is driven through the distribution head 60 in a one-to-one ratio in a downward direction. When the carriage 40 is moved from the front to the back with the timing belt 64 stationary, the stock material 12 is driven through the distribution head 60 in a one-to-one ratio in an upward direction. The feeder belts 61 and 62 may also be driven independently by the timing belt 64. The timing belt drive 66 powers the timing belt 64 and allows the feeder belts 61 and 62 to be controlled independently of the linear motion of the carriage 40. Through the use of electronic control, the timing belt 64 can be driven forward or backward to allow for any feeder belt speed. This allows for the distribution speed of the stock material 12 to vary across the linear motion span. This further allows the amount of stock material 12 distributed in a given area to vary. It is advantageous to be capable of varying the stock material 12 distribution speed to maintain an uniform stockpile 14.

The carriage 40 also includes a pair of strip retaining mechanisms 90 and 91, located on opposite ends of the underside of the carriage 40, as depicted in FIG. 2. The strip retaining mechanisms 90 and 91 serve to fold down the stock material 12 as it is laid back over itself at one edge of the stock pile 14, as the distribution head 60 reverses its direction in the carriage 40. The strip retaining mechanisms 90 and 91 are each timed to apply an alternating holding force to the folded edge of the stock material 12 for a short time, and then to release their grip of the stock material 12 in order to apply a force on the next folded edge as the stock material 12 is continuously laid back and forth to form a stock pile 14, as shown in FIG. 2.

An enlarged view of one of the strip retaining mechanisms 90 is depicted in FIG. 3. The two strip retaining mechanisms 90 and 91 are identical in structure and function, so that discussion of only one is necessary. Each of the strip retainers 90 and 91 comprise a brace support frame 92, with a moveable arm 94 pivotally mounted from the lower inward end of the brace support frame 92. A grip member 96 is located at the end of each moveable arm 94. The grip member 96 directly contacts and folds the stock material 12. The moveable arms 94 are actuated by an arm actuating means 98, which consists of a pneumatic cylinder and strut. Alternatively, the actuating means 98 could be a hydraulic cylinder, a linear motor or other like devices.

As best depicted in FIG. 2 the outer frame 20 includes an outer frame base 70, which is formed of a number of structural members that extend outwardly from the outer frame 20 and are located beneath the carriage 40. A rotating platform 72 is located on top of the base 70. The rotating platform 72 is rotated by a platform motor 74 and a platform drive. The platform drive is a chain and sprocket, belt or other suitable drive means. A pallet 16 is located on top of the rotating platform 72 for receiving the distributed stock material 12. The rotating platform 72 is rotated ninety degrees at the completion of each layer of the stock material 12 on the pallet 16. This results in each higher layer of stock material 12 being placed onto the stock pile 14 in a direction normal to the previous layer. This provides for interlocking layers of stock material 12 and a sturdier stock pile 14.

The operation of the present assembly 10 will be explained with reference to FIG. 2. The arrows 100 located in FIG. 2 show the direction of flow of the stock material 12 as it moves through the assembly 10. The automated reciprocal stacking assembly 10 is first set up by placing a pallet 16 onto the rotating platform 72. The inner frame 30, the carriage 40, the distribution head 60 and the rotating platform 72 are next positioned so that the first portion of stock material 12 will be distributed onto the pallet 16. The elements of the assembly are all positioned and controlled by a control panel 86 with controls 88.

The stock material 12 is delivered to the distribution head 60 by the distribution end 82 of the conveyor 80. The conveyor 80 is a typical roller conveyor and is angled to allow for a much higher entrance for the stock material 12. The distribution end 82 is initially positioned over the large opening 69 of the distribution head 60.

As the first end of the stock material 12 is deposited on the pallet 16, the first strip retainer 90 is actuated to lower the moveable arm 94 and hold the stock material 12 in its folded position on the pallet 16. The rolling ring drive is then actuated to travel along the carriage slide members 110 and 111, thereby driving the distribution head 60 from one end of the carriage 40 to the other. As the distribution head 60 begins to reciprocate toward its initial position, it forms an overlapping fold of stock material 12. The moveable arm 94 of the second strip retaining mechanism 91 is lowered to hold or grip the double over end of the stock material 12. At this point the first strip retainer 90 has lifted its moveable arm 94 to remain clear of the pallet 16 and stock material 12.

The inner frame 30 and the carriage 40 are moved laterally with each pass of the distribution head 60 so that the distribution head 60 is repositioned precisely over the pallet 16 so that an even stock pile 14 is layered on the pallet 16. This lateral movement across the outer frame 20 is actuated by the electric motor 39 to turn the inner frame drive 38. This process continues until an even layer of stock material 12 is distributed on the pallet 16.

Once the inner frame 30 and carriage 40 have moved from one side of the pallet 16 to the other, the direction of the electric motor 39 and the inner frame drive 38 are reversed. The continuing operation of the assembly 10 results in another thickness of the stock material 12 to be placed over the first thickness. When the inner frame 30 and carriage 40 have reached the initial position, the platform motor 74 is actuated so that the platform drive turns the rotating platform 72 ninety degrees. The stacking process is then reinitiated, and a layer of stock material 12 is distributed in the same manner, except that this second layer is now placed normal to the direction of the second layer. The resulting stockpile 14 is shown in FIGS. 1–3.

As the stockpile 14 is stacked higher, the carriage 40 is raised in order to provide room for additional layers of stock material 12. An automated sensing means 89 selected from, but not limited to, photoelectric cells, infrared detectors or other mechanical, electrical or optical sensors, is used to detect the height of the stock pile 14 and signals the carriage drive motor 50 to actuate the carriage drive 52 to raise the carriage 40.

The above process is continued until a stockpile 14 of desired height is reached. If, at any point in the process, the speed of the distributed material must be varied to maintain a uniform stock pile 14, the positive timing belt 64 may be actuated by the timing belt drive 66 so that the stock material 12 may pass through the distribution head 60 at a speed that is independent of the liner motion of the carriage 40. This will allow for more or less stock material to be distributed in specific areas on the stockpile 14.

Once the desired stockpile 14 height is reached, the stock material 12 is cut at the distribution head 60 and the assembly 10 is stopped. The pallet 16 is then removed from the rotating platform 72 by a forklift or other suitable means and an empty pallet 16 is placed on the rotating platform 72. The various movable elements are repositioned at the initial positions by the control panel 86 and the process is restarted.

It is to be understood that the present invention is not limited to the embodiments described above, but encompasses any and all embodiments within the scope of the following claims.

We claim:

1. An automated reciprocal stacking assembly, comprising:

a stationary, vertically disposed first frame having base members extending therefrom;

a vertically disposed, laterally reciprocating second frame extending from said first frame;

a vertically movable carriage extending horizontally from said second frame above the base members of said first frame;

a longitudinally reciprocating distribution head disposed on said carriage wherein said reciprocating distribution head comprises a plurality of feeder belts;

first and second sheet retaining means located on opposing ends of said carriage for retaining a sheet of stock material on a pallet;

a rotating platform located on top of the base members of said first frame and below said carriage, the platform being adapted for receiving the sheet of stock material from said distribution head;

a conveyor means having an output end disposed above said distribution head for delivering a continuous length of the sheet material through said distribution head for stacking on said rotating platform; and a positive timing belt connected to said reciprocating distribution head so that said reciprocating distribution head is capable of moving independently of said carriage and dispensing the sheet material at varying speeds.

2. The automated reciprocal stacking assembly according to claim 1, wherein said reciprocating distribution head has a large opening defined between said plurality of feeder belts adapted for receiving the sheet material from said conveyor means.

3. The automated reciprocal stacking assembly according to claim 1, wherein said reciprocating distribution head further comprises a tensioning device disposed between said plurality of feeder belts.

4. The automated reciprocal stacking assembly according to claim 1, wherein each said sheet retaining means comprises a pneumatically actuated moving arm.

5. The automated reciprocal stacking assembly according to claim 1, further comprising a first drive means for laterally reciprocating said second frame on said first frame.

6. The automated reciprocal stacking assembly according to claim 1, further comprising a second driving means for moving said carriage vertically on said second frame.

7. The automated reciprocal stacking assembly according to claim 1, further comprising a third driving means for reciprocating said distribution head along said carriage.

8. The automated reciprocal stacking assembly according to claim 1, further comprising:

a first drive means for laterally reciprocating said second frame on said first frame;

a second drive means for moving said carriage vertically on said second frame; wherein said first drive means and said second drive means include threaded lateral and vertical shafts engaging said second frame and said carriage, respectively.

9. The automated reciprocal stacking assembly according to claim 1, further comprising a third drive means for reciprocating said distribution head along said carriage, said third drive means including a linear module timing belt drive.

10. The automated reciprocal stacking assembly according to claim 1, further including electric motor power means for driving said second frame laterally, for moving said carriage vertically, and for reciprocating said distribution head along said carriage.

11. The automated reciprocal stacking assembly according to claim 1, further comprising a limit switch disposed on said first frame for limiting movement of said second frame, said carriage and said reciprocating distribution head.

12. The automated reciprocal stacking assembly according to claim 1, wherein said conveyor means is a roller conveyor.

* * * * *